US006719050B2

(12) United States Patent
Longacre

(10) Patent No.: US 6,719,050 B2
(45) Date of Patent: Apr. 13, 2004

(54) METHOD AND APPARATUS FOR REMOVING SOLID MATERIAL FROM A WELL USING A ROTARY PUMP

(76) Inventor: Kenneth E. Longacre, 4907 Monteagle Dr., Farmington, NM (US) 87402-3077

( * ) Notice: Subject to any disclaimer, the term of this patent is extended or adjusted under 35 U.S.C. 154(b) by 0 days.

(21) Appl. No.: 10/066,610

(22) Filed: Feb. 6, 2002

(65) Prior Publication Data

US 2003/0145990 A1 Aug. 7, 2003

(51) Int. Cl.[7] ..... E21B 43/34; E21B 37/08

(52) U.S. Cl. ..... 166/265; 166/311; 166/105.3; 166/105.1; 175/314; 175/323

(58) Field of Search ..... 166/105.1, 105.3, 166/105.4, 265, 311, 168, 107, 74; 175/102, 65, 314, 323, 217, 218

(56) References Cited

U.S. PATENT DOCUMENTS

| | | | | | |
|---|---|---|---|---|---|
| 1,694,329 | A | | 12/1928 | Le Bus | |
| 2,171,539 | A | * | 9/1939 | Burns | 166/109 |
| 3,572,431 | A | * | 3/1971 | Hammon | 166/99 |
| 3,900,074 | A | * | 8/1975 | Lee | 175/242 |
| 4,190,113 | A | | 2/1980 | Harrison | |
| 4,421,182 | A | | 12/1983 | Moody et al. | |
| 4,505,341 | A | | 3/1985 | Moody et al. | |
| 4,721,156 | A | * | 1/1988 | Campbell | 166/99 |
| 5,095,976 | A | | 3/1992 | Appleton | |
| 5,139,089 | A | * | 8/1992 | Wacker | 166/311 |
| 5,314,018 | A | | 5/1994 | Cobb | |
| 5,417,281 | A | | 5/1995 | Wood et al. | |
| 5,516,360 | A | * | 5/1996 | Normandeau et al. | 96/207 |
| 5,553,669 | A | * | 9/1996 | Trainer | 166/105.1 |
| RE35,454 | E | | 2/1997 | Cobb | |
| 5,611,397 | A | | 3/1997 | Wood | |
| 5,662,167 | A | * | 9/1997 | Patterson et al. | 166/265 |
| 6,059,030 | A | | 5/2000 | Celestine | |
| 6,073,693 | A | * | 6/2000 | Aldridge | 166/217 |
| 6,158,512 | A | * | 12/2000 | Unsgaard | 166/311 |
| 6,176,307 | B1 | * | 1/2001 | Danos et al. | 166/51 |
| 6,190,141 | B1 | | 2/2001 | Henry | |
| 6,196,319 | B1 | * | 3/2001 | Henskens et al. | 166/311 |
| 6,394,183 | B1 | * | 5/2002 | Schrenkel et al. | 166/265 |
| 2002/0157822 | A1 | * | 10/2002 | Tieben | 166/68 |

OTHER PUBLICATIONS

Polar Completions Engineering brochure, "Pump to Surface Bailer", (date unknown), 7 pages.
Bull Dog Tool, Inc., web page, "Clean Out Methods", at least as early as Jul. 10, 2001. 1 page.
EVI Tools, Inc. brochure, "Service Tools' Accessories"; 1 page, 8/97.
Baker Hughes website pages, "World–Record Horizontal Gravel Packs Improve Productivity", at least as early as Nov. 14, 2001, 2 pages.
Flapper Value Pictures (source and data unknown), 1 page.
Baker Hughes brochure "Gravel Pack Systems Technical Unit", Single Screen Prepack, Mar., 1998, 4 pages.

* cited by examiner

*Primary Examiner*—David Bagnell
*Assistant Examiner*—Shane Bomar
(74) *Attorney, Agent, or Firm*—Staas & Halsey LLP

(57) ABSTRACT

A tool for removing solid particles from a well after sand fracturing, drilling, etc. The tool includes a flapper valve assembly above a drill bit, a sand screen, and a screw pump. Fluid in the well, with the solid particles therein, is pumped into the tool by rotating the screw pump, wherein the fluid moves past the bit, across the flapper valve assembly, and through the sand screen. The solid particles stay in a cavity above the flapper valve, but the fluid moves further along the screw pump and is returned along the outside of the tool to the bit, to start the cycle over again. Over time, the cavity fills with solid particles, and the device is raised to the surface, where the accumulated solid particles are dumped. The device can be re-introduced into the well to remove more solid particles, if necessary.

36 Claims, 4 Drawing Sheets

METHOD AND APPARATUS FOR REMOVING SOLID MATERIAL FROM A WELL USING A ROTARY PUMP

BACKGROUND OF THE INVENTION

1. Field of the Invention

The present invention relates to well drilling tools and, more particularly, to a tool for extracting solid particles, such as sand and debris, from a well hole.

2. Description of the Related Art

It is well-known in the well bore formation art that debris is an unwanted by-product of sand fracturing, drilling out, natural formation fill-up, etc. In some wells, circulating this debris to the surface is not feasible due to loosing circulation into weak zones, or it is not cost-effective. For example, in order to clean out debris from a low fluid level well, an air unit or nitrogen unit is required to blow the debris out. Both methods are expensive and not environmentally friendly.

A reciprocating sand pump could be run into the well bore. Such a pump usually requires a significant amount of fluid in the well to allow the pump to move up and down through the fluid. Also, if the debris is hard, the reciprocating pump has difficulty picking up the debris. That is, one must drill a few inches then stroke the pump, and keep repeating this operation.

In light of the above, a need exists for a well bore tool that is capable of removing solid particles from the well bore with greater efficiency and reliability.

SUMMARY OF THE INVENTION

Accordingly, it is a purpose of the present invention to provide a well tool that does not have to be raised and lowered in a column of water to operate, thereby requiring very little fluid to remove the solid particles.

It is also a purpose of this invention to provide a well tool which prevents sand, debris, etc., entering the tool from clogging the tool.

It is another purpose of the present invention to provide a well tool that eliminates the need for expensive and environmentally unfriendly air or hydrogen blow outs.

It is another purpose of the present invention to provide a pump that can be run into a well bore to remove debris left behind after sand fracturing, etc., even in wells where circulating debris to the surface is not feasible, or is not cost effective.

To achieve the foregoing and other purposes of the present invention there is provided a well tool including: a flapper valve assembly above a drill bit; a sand screen; and a screw pump. The tool is used for removing unwanted solid materials, such as sand, left in a hole after sand fracturing, drilling, etc. The fluid in the hole, with the solid particles therein, is pumped into the device past the bit, by rotating the tool which rotates the pump, and across the flapper valve assembly. Only the fluid then moves through the holes in the sand screen, and the solid particles stay in a cavity formed above the flapper valve. The fluid moves along the screw pump and is returned downward along the outside of the tool to the bit, to start the cycle over again. Over time, the cavity collects the solid particles therein and the device is raised to the surface, where the accumulated solid particles are dumped, and the device is re-introduced into the hole to remove more solid particles, if necessary.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
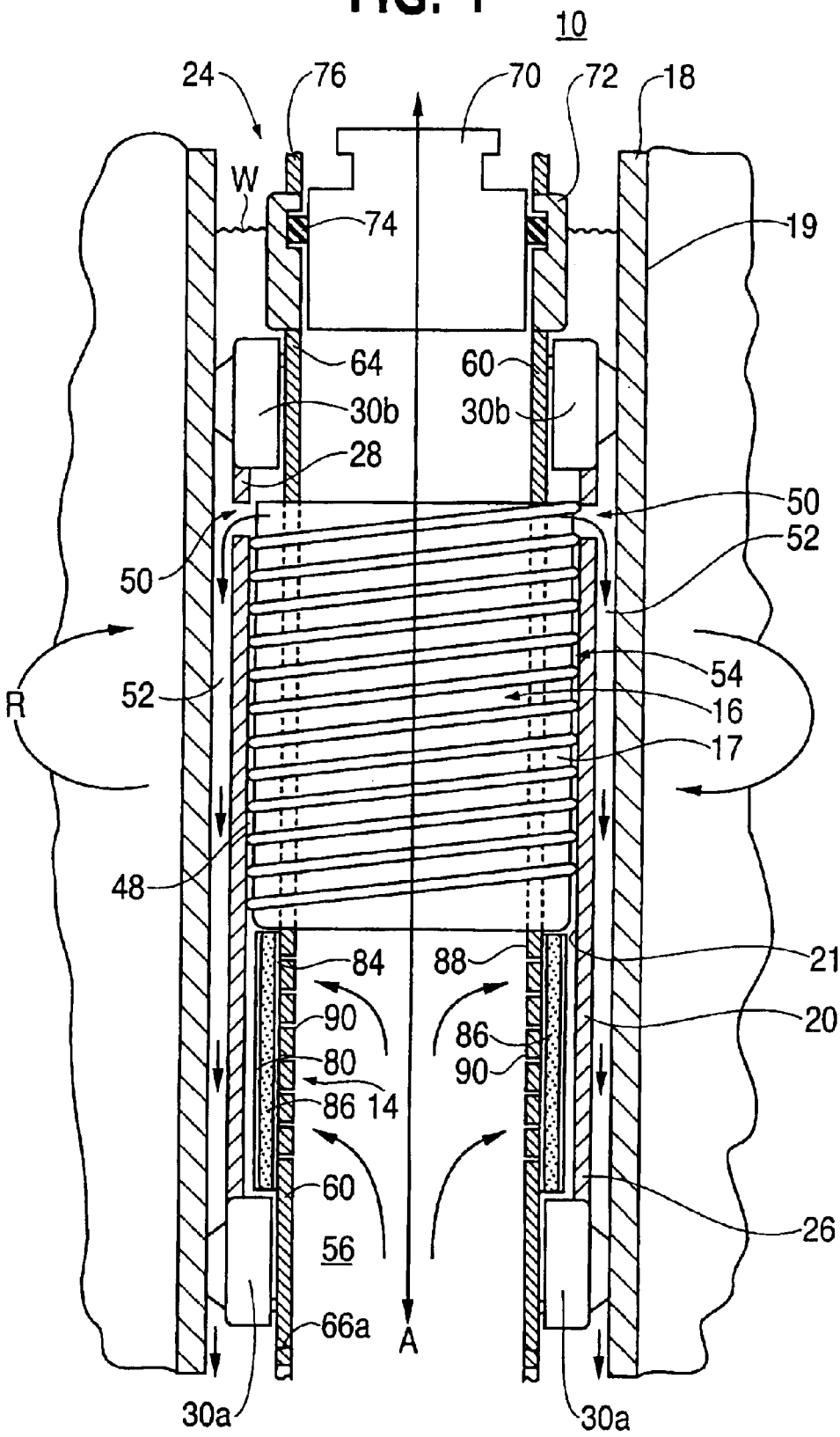
FIG. 1 is a side, partial cross-sectional view of an upper portion of the tool according to the present invention, illustrating particularly the screw pump and the sand screen.
Figure 2:
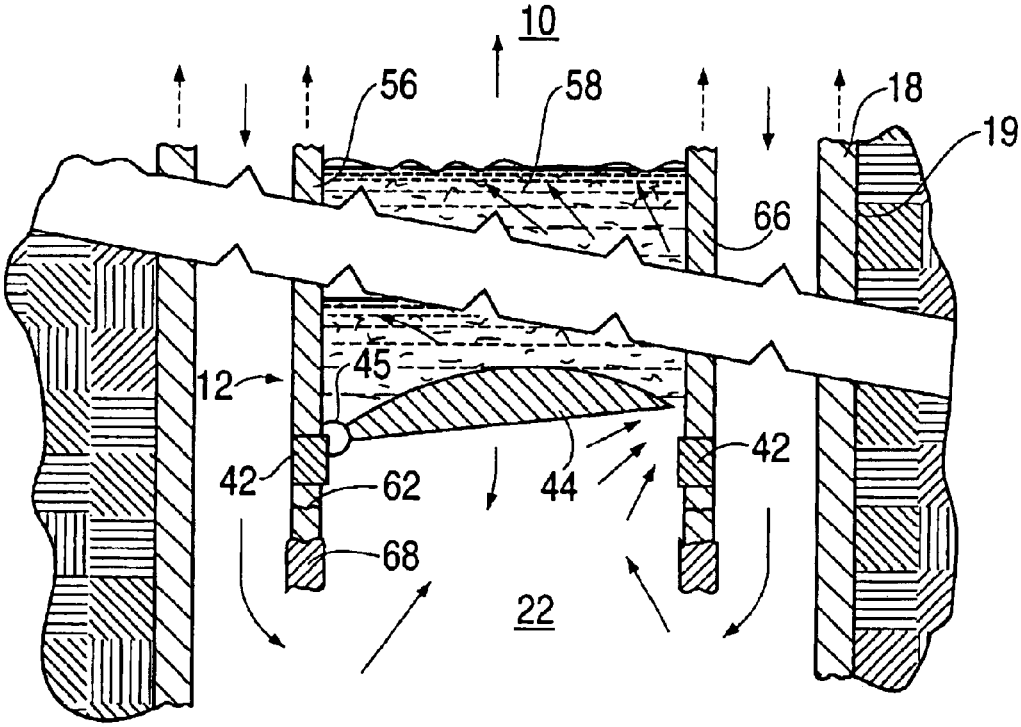
FIG. 2 is a side, cross-sectional view of the lower portion of the tool according to the present invention, which is a continuation of the tool shown in FIG. 1, and illustrating particularly the bit and flapper valve.

As shown particularly in FIGS. 1 and 2, the tool 10 includes generally the following components along an axis "A": a flapper valve assembly 12, a sand screen 14, and a screw pump 16. The tool 10 is intended to be received in a well bore casing 18 positioned in a well bore 19, with a first, inlet end 22 of the tool 10 being inserted into and down the conventional casing 18. A second opposite end 24 of the tool 10 is operatively accessible from the surface (not shown) where the well bore 19 is drilled.

More particularly, the tool 10 includes an outer tubular housing 20 having a first end 26 and a second opposite end 28. The outer tubular housing 20 is a true bore piece of pipe, and is, e.g., 3¾" OD×3¼" ID with a chromed inner surface 21.

Figure 3:
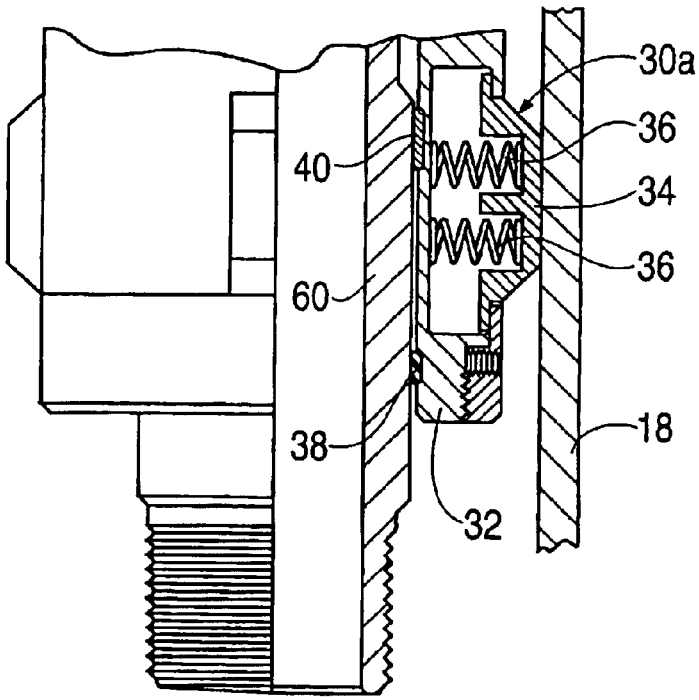
FIG. 3 is a side, cross-sectional view of a drag block assembly used with the tool.

Threaded to each end 26, 28 of the outer housing 20 is a drag block assembly 30*a*, 30*b*, respectively. As shown in FIG. 3, exemplary assembly 30*a* includes a drag block housing 32, four drag blocks 34 (one shown), four springs 36 (two shown) received between the housing 32 and each drag block 34 to bias each drag block 34 radially outwardly, and an inwardly oriented seal 38 positioned between the housing 32 and an inner tubular housing 60, described below, as is an inwardly placed bronze bearing 40. The connection between the block housing 32 and the outer tubular housing 20 can be threaded.

Each block 34 is depressed inwardly against the casing 18, as it enters the casing 18. This prevents the outer housing 20 from rotating within the casing 18 as the tubing string and tool 10 are rotated, but will slide down the casing 18 as the tubing is run up and down the casing 18.

Referring again to FIG. 1, the second end 28 of the outer housing 20 includes fluid release ports 50 which open to a space 52 formed between the outer tubular housing 20 and the well bore casing 18.

Figure 6:
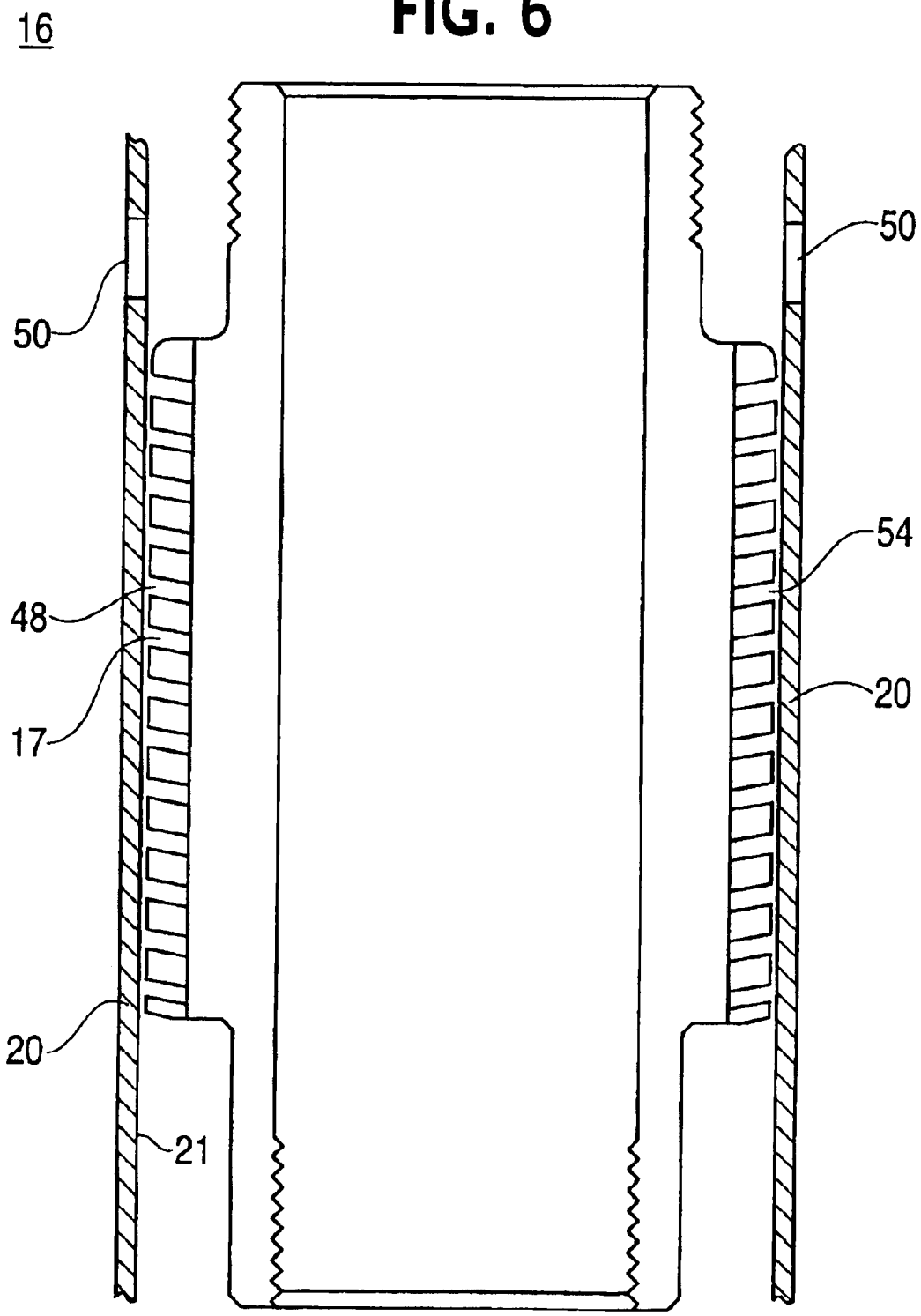
FIG. 6 is a side, cross-sectional view of the screw pump.

Below the release ports 50, is the screw pump 16. As shown in FIGS. 1 and 6, the screw pump 16 includes a continuous spiral groove 17 to lift fluid upward when the tool 10 (and the pump 16 therewith) is rotated to the right, as indicated by arrow "R" in FIG. 1, and as discussed below.

A space 48 formed between the groove 17 and the inner surface 21 of the outer housing 20 creates a pump chamber 54.

The screw pump 16 can be made of a 4140 steel pipe material about 48" long and with a 3¼" OD and a 2" ID. The ends can be turned on a lathe to a 2⅜" OD and threaded at one end with a 2⅜" OD no upset 10RD (rounded threads per inch) thread and a 2⅜" stub acme thread at the opposite end. Inbetween these ends there can be formed a course ½" wide 1½ thread machined ½" deep on the 3¼" OD of the steel pipe.

Coaxial with, but internal of, the outer tubular housing 20, and internal of the screw pump 16, there is provided the inner tubular housing 60. As shown in FIGS. 1 and 2, the housing 60 has a first, inlet end 62 and a second, opposite end 64.

At the first, inlet end 62 there is a tail pipe section 66, at a lower end of which there is removably attached a conventional drill bit 68. That is, the drill bit 68 is threadingly engaged with the flapper valve assembly 12, which in turn is threadingly engaged with the tail pipe 66. The tail pipe 66, which can be one or more sections, can be attached to the inner tubular housing 60 via a threaded connection 66*a*.

Adjacent to, but somewhat upstream of the bit 68, the flapper valve assembly 12 is connected to the tail pipe 66. This assembly 12 includes a housing 42 which receives a flapper valve 44 via a pivot point 45, which valve 44 seats against the housing 42, when the valve 44 is in the closed position. FIG. 1 shows the valve 44 in an open position. An alternative to the valves 44 may be a movable door(s), or equivalent. In either regard, the internal diameter of the first inlet end 22 of the inner tubular housing 60 will dictate how large a door or valve 44 can be.

Figure 4:
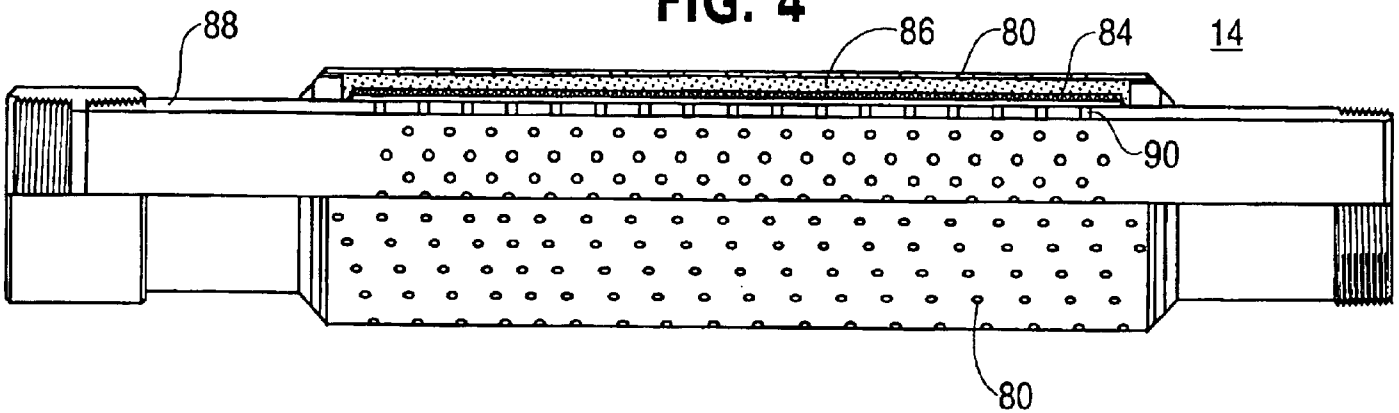
FIG. 4 is a side, partial longitudinal cross-sectional view of the sand screen according to the present invention.
Figure 5:
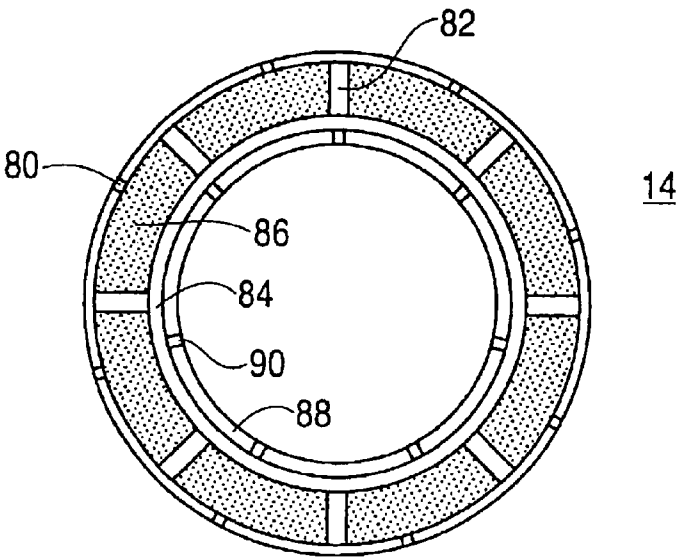
FIG. 5 is a cross-sectional view of the sand screen of the invention.

Between the flapper valve assembly 12 and the pump 16, there is formed the sand screen 14, which is shown in FIGS. 1, 4 and 5. The sand screen 14 permits fluid to enter the pump chamber 54, but keeps any solid particles above a predetermined size that reach this area of the tool 10, out of the chamber 54. That is, most of the solid particles separate from the fluid after the flapper valve 12 and before the screen 14, with the solid particles accumulating in a pump cavity 56 above the flapper valve assembly 12.

The screen 14 is designed for resistance to fluid erosion while retaining desirable permeability and filtration properties. The flow properties of the screen are usually unaffected by normal oil field treating fluids (e.g., acids, clay stabilizers).

The sand screen 14 includes, as shown particularly in FIGS. 4 and 5, an outer perforated screen 80, a plurality of spaced separator bars 82, an inner wire mesh screen 84, a bonded filler material 86 made usually of sand and epoxy, and a tube 88 having a plurality of openings 90 formed substantially perpendicular or otherwise angled relative to the axis A of the tool 10.

A 3' length of the sand screen 14 can be screwed into the lower end of the screw pump 16. The screen 14 is chosen, e.g., to prevent solid particles 58 larger than 0.008" from passing through the screen 14. A manufacturer of such screens 14 is Baker Hughes of Bakersfield Calif. An alternative to such a screen is a sieve.

Similar to the tail pipe section 66, the sand screen 14 can be removably connected to the inner tubular housing 60 via a threaded connection.

The pump cavity 56 extends from the flapper valve assembly 12 to the area below the screw pump 16. The cavity 56 can be very short or long depending on the amount of solid particles to be cleaned out, and the fluid level "W" that is in the well bore 19.

At the second end 64 of the inner housing 60 there is formed a steel blanking plug 70 which can be locked into a profile nipple 72 to seal off the interior of the tool 10. The profile nipple 72 has a 2⅜" Eu 8rd Box x 2⅜" sub acme box. A seal 74 is formed between the profile nipple 72 and the blanking plug 70. The plug 70 has two retractable locks (not shown) which lock into a groove (not shown) of the nipple 72. The nipple is threaded to the screw pump 16 and the tubing string 76 above it.

If a lower section of the tool 10 gets stuck in the solid particles (e.g., sand or debris), this plug 70 can be removed and retrieved on a wire line. A cutter can then be run on an electric line to cut the lower section of tubing so that the upper portion of the tool 10 can be retrieved from the well bore, and the lower stuck section can be separately recovered by removing the stuck solid particles therefrom.

A conventional tubing string 76 attaches to the second end 64 of the inner housing 60 and extends to the surface. The tubing string 76 includes piping usually in 30 to 32' lengths. Each section is threaded so that it can be screwed together to form one solid length of pipe. The string 76 is responsible for rotating the tool 10 as described below, relative to the well bore casing 18.

The tool 10 is a fixed part of the tubing string 76 so that there is a solid connection from the string to the bit 68, whereby the bit 68 can be rotated in the well bore, and solid particles can be cleaned out as the tool 10 is rotated and lowered. The weight on the bit 68 can be controlled at the surface using conventional methods.

Operation of the tool 10 according to the present invention is as follows: The desired drill bit 68 is threaded under the flapper valve assembly 12, which is threaded onto the tail pipe section 66. As many feet of the inner tubular housing 60 as necessary should be run, to provide adequate capacity in the cavity 56 for the solid particles. The pump 16 is placed below the fluid level "W" in the well bore when starting. That is, the screw pump 16 must be in fluid in order to clean out solid particles therein. A swivel (known tool used on a rig to rotate tubing) is connected to the tubing string at the surface.

The tubing string 76 is then rotated to the right "R" using the swivel. The inner housing 60, including the screw pump 16, turns inside the outer housing 20. The spring loaded drag blocks 34, which are biased against the inside of the well bore casing 18, cause significant friction therebetween, and prevent the outer housing 20 from turning inside the well bore 19. As the tubing is rotated, the solid material is pumped into the tail pipe 66 cavity 56 through the bit 68 and flapper valve assembly 12, and the tubing 76 is lowered by removing the swivel at the surface and adding another section of pipe to the tubing string.

As the tool 10 is rotated, and lowered by the rig into the well bore 19, the fluid and solid materials 58 move from the well bore 19 bottom and past the flapper valve 44. The fluid moves past the sand screen 14, and necessarily takes with it very small solid particles having a size below the particle size being filtered. The solid particles 58 having a size larger than the predetermined size, are prevented from passing by the sand screen 14 and instead accumulate in the cavity 56.

After the fluid passes the screen 14, it moves along the pump chamber 54, upwardly through the fluid release ports 50, out into the space 52 between the outer tubing 20 and well bore casing 18, and is directed to and re-enters the tool 10 through inlet end 22, again picking up the solid particles 58 from the bottom of the well bore 19.

When final depth is accomplished, or the cavity 56 is full (at which point the tool will no longer go into the solid particles), the tool 10 is pulled from the well bore 19. The tail pipe section 66 is then unscrewed from the remainder of the inner housing 60, the captured solid particles are dumped from inside the tool 10 at the surface, and the tool 10 is re-assembled and ready to be run again, if needed.

The benefits of the invention over the prior art include the following: very little fluid is needed in order to remove the solid particles, as the device does not have to be raised and lowered in a column of water to operate (some holes won't even hold the amount of water needed by a reciprocating device because of weak zones); and there is no need for the expensive and environmentally unfriendly air or hydrogen blow outs. Further, as noted above, a reciprocating pump operates by being moved up and down to make the pump suck water out. If rotation is also used with a reciprocating pump, the lower end of the tubing goes into the debris, and is stuck or plugged up. Reciprocating while rotating is also very hard to do. Finally, selecting the appropriate weight on the bit with a reciprocating pump is very difficult.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A device for removing solid material from a well bore comprising:

an elongated tool having an axis, a first inlet end and a second end;

a valve located adjacent to the first end;

a screen located between the valve and the second end, the screen allowing the passage of fluid, but not solid material above a predetermined size;

a cavity located between the valve and the screen; and a screw pump located between the screen and the second end;

wherein, the screw pump is capable of pulling fluid entrained with the solid material from the well bore into the first end of the tool and through the valve, the fluid is separated from the solid material above a predetermined size by the screen, the fluid moves along the pump and is reintroduced into the well bore, and the solid material above the predetermined size accumulates in the cavity.

2. The device as recited in claim 1, wherein the valve is a flapper valve.

3. The device as recited in claim 1, wherein the device is connected to a tubing string which leads to the surface, which tubing string is capable of rotating the device.

4. The device as recited in claim 1, further comprising a drill bit attached to the first, inlet end of the second housing.

5. The device as recited in claim 1, wherein the device includes a removable portion including the valve and the cavity.

6. A device for removing solid material from a well, said device capable of being inserted at a surface of the well into a well bore casing and having a longitudinal axis, comprising:

a first tubular housing having a first end and an opposite second end;

at least one member attached to an exterior of the first housing and abutting the well bore casing for preventing rotation of the first housing relative to the well bore casing;

a second tubular housing having a first, fluid inlet end and a second, opposite end, being arranged coaxially and at least part internally of the first housing, and being rotatable relative to the first housing;

a valve adjacent the first end of the second housing and being movable between a first open position and a second closed position;

a selective passage formed between the valve and the second end to the second housing;

a screw pump formed between an exterior of the second housing and the first housing; and a cavity formed in the second housing between the valve and the selective passage, wherein, fluid and solid material can enter the first inlet end of the second housing, past the valve, and the fluid can pass through the selective passage, and along the screw pump, but the solid material cannot pass through the selective passage and accumulates in the cavity.

7. The device as recited in claim 6, wherein the valve is a flapper valve.

8. The device as recited in claim 6, wherein the selective passage is a sand screen.

9. The device as recited in claim 8, wherein the sand screen is removably attached to the second housing.

10. The device as recited in claim 6, wherein the second end of the second housing is connected to a tubing string which leads to the surface, which tubing string is capable of rotating the second housing relative to the first housing.

11. The device as recited in claim 6, wherein the at least one member is a biased drag block assembly attached to the first and second ends of the first housing.

12. The device as recited in claim 11, wherein the drag block assembly includes a drag block housing, a radially outwardly positioned drag block, and at least one spring received between the housing and the block to bias the block radially outwardly.

13. The device as recited in claim 6, wherein the at least one opening is a plurality of fluid release ports which open to a space formed between the second tubular housing and the well bore casing.

14. The device as recited in claim 6, wherein the screw pump includes a continuous, external spiral groove to lift fluid upward when the device is rotated.

15. The device as recited in claim 14, wherein a pump chamber is formed between the groove and an inner surface of the first housing.

16. The device as recited in claim 6, further comprising a drill bit attached to the first, inlet end of the first housing.

17. The device as recited in claim 6, wherein the second housing includes a removable portion including the valve and the cavity.

18. The device as recited in claim 6, wherein the solid material is at least one of sand and debris.

19. The device as recited in claim 6, wherein the valve is a flapper valve assembly including a housing which pivotally receives a flapper valve seating against the housing, when the valve is in the closed position.

20. The device as recited in claim 6, wherein the screw pump is removably attached to the second housing.

21. The device as recited in claim 6, further comprising a removable blanking plug connected to the second end of the second housing via a profile nipple, wherein a seal is formed between the plug and the nipple.

22. A method for removing solid particles from a well, comprising the steps of:

(a) placing a tool with a screw pump into the well, such that the pump is below a level of fluid in the well;

(b) rotating the tool so that the screw pump pulls fluid and solid particles from the well into an inlet of the tool; and (c) allowing the fluid to pass through a screen, but causing the solid particles to be collected in a cavity of the tool, wherein the fluid and solid particles entering the tool are caused to move past a closable valve prior to reaching the screen.

23. The method as recited in claim 22, further comprising the steps of:

(d) raising the tool to a surface of the well; and (e) removing the solid particles from the cavity of the tool.

24. The method as recited in claim 23, further comprising the steps of:

(f) reintroducing the tool into the well; and (g) removing additional solid particles from the well by following steps (b) through (e) again.

25. The method as recited in claim 22, further comprising the step of rendering a portion of the tool non-rotatable relative to a casing of the well.

26. A method for removing solid particles from a well, comprising the steps of:

(a) placing a tool with a screw pump into the well, such that the pump is below a level of fluid in the well;

(b) rotating the tool so that the screw pump pulls fluid and solid particles from the well into an inlet of the tool; and (c) allowing the fluid to pass through a screen, but causing the solid particles to be collected in a cavity of the tool; and (d) moving the tool down into the well as it is being rotated.

27. The method as recited in claim 26, further comprising the steps of:

(e) raising the tool to a surface of the well; and (f) removing the solid particles from the cavity of the tool.

28. The method as recited in claim 27, further comprising the steps of:

(g) reintroducing the tool into the well; and (h) removing additional solid particles from the well by following steps (b) through (e) again.

29. The method as recited in claim 26, further comprising the step of rendering a portion of the tool non-rotatable relative to a casing of the well.

30. A method for removing solid particles from a well, comprising the steps of:

(a) placing a tool with a screw pump into the well, such that the pump is below a level of fluid in the well;

(b) rotating the tool so that the screw pump pulls fluid and solid particles from the well into an inlet of the tool; and (c) allowing the fluid to pass through a screen, but causing the solid particles to be collected in a cavity of the tool; and (d) reintroducing the fluid that passes through the screen into the inlet of the tool.

31. The method as recited in claim 30, further comprising the steps of:

(e) raising the tool to a surface of the well; and (f) removing the solid particles from the cavity of the tool.

32. The method as recited in claim 31, further comprising the steps of:

(g) reintroducing the tool into the well; and (h) removing additional solid particles from the well by following steps (b) through (e) again.

33. The method as recited in claim 30, further comprising the step of rendering a portion of the tool non-rotatable relative to a casing of the well.

34. A method for removing solid particles from a well, comprising the steps of:

(a) placing a tool with a screw pump into the well, such that the pump is below a level of fluid in the well;

(b) rotating the tool so that the screw pump pulls fluid and solid particles from the well into an inlet of the tool;

(c) allowing the fluid to pass through a screen, but causing the solid particles to be collected in a cavity of the tool;

(d) raising the tool to a surface of the well; and (e) removing the solid particles from the cavity of the tool, wherein the removing step comprises the step of separating the cavity of the tool from a remainder of the tool.

35. The method as recited in claim 34, further comprising the steps of:

(f) reintroducing the tool into the well; and (g) removing additional solid particles from the well by following steps (b) through (e) again.

36. The method as recited in claim 34, further comprising the step of rendering a portion of the tool non-rotatable relative to a casing of the well.

* * * * *